US006020853A

United States Patent [19]

Richards et al.

[11] Patent Number: 6,020,853

[45] Date of Patent: Feb. 1, 2000

[54] MICROSTRIP PHASE SHIFTING REFLECT ARRAY ANTENNA

[75] Inventors: Randy J. Richards, Plano; Edwin W. Dittrich, McKinney; Oren B. Kesler; Jerry M. Grimm, both of Plano, all of Tex.

[73] Assignee: Raytheon Company, Lexington, Mass.

[21] Appl. No.: 09/181,591

[22] Filed: Oct. 28, 1998

[51] Int. Cl.[7] ..... H01Q 1/38

[52] U.S. Cl. ..... 343/700 MS; 343/754; 343/846

[58] Field of Search ..... 343/700 MS, 754, 343/846; H01Q 1/38

[56] References Cited

U.S. PATENT DOCUMENTS

| | | | |
|---|---|---|---|
| 4,053,895 | 10/1977 | Malagisi | 343/700 |
| 4,684,952 | 8/1987 | Munson et al. | 343/700 |
| 4,777,490 | 10/1988 | Sharma et al. | 343/754 |
| 5,511,238 | 4/1996 | Bayraktaroglu | 343/700 MS |
| 5,777,581 | 7/1998 | Lilly et al. | 343/700 MS |
| 5,835,062 | 11/1998 | Heckaman et al. | 343/700 MS |

OTHER PUBLICATIONS

Colin, Jean–Marie, "Phased Array Radars in France: Present & Future", IEEE, pp. 458–462, Jun. 1996.

Huang, John, "Bandwidth Study of Microstrip Reflectarray and a Novel Phased Reflectarray Concept", IEEE, pp. 582–585, May 1995.

Huang, John and Ronald J. Pogorzelski, "A Ka–Band Microstrip Reflectarray with Elements Having Variable Rotation Angles", IEEE, vol. 46, N0. 5, pp. 650–656, May 1998.

Oberhard, M.L. and Y. T. Lo, "Simple Method of Experimentally Investigating Scanning Microstrip Antenna Array without Phase–Shifting Devies", Electronic Letters, vol. 25. No. 16, pp. 1042–1043, Aug. 3, 1989.

Swenson, G.W. Jr and Y.T. Lo, "The University of Illinois Radio Telescope", IRE, pp. 9–16, Jan. 1961.

Wu, T.K., "Phased Array Antenna for Tracking and Communication with LEO Satellites", IEEE, pp. 293–296, Jun. 1996.

*Primary Examiner*—Don Wong
*Assistant Examiner*—Hoang Nguyen
*Attorney, Agent, or Firm*—Baker & Botts, L.L.P.

[57] ABSTRACT

A circularly polarized reflect array antenna having a plurality of antenna elements, where each antenna element has an electrically conductive patch, at least two electrically conductive stubs positioned along the periphery of the patch, and at least two switches each operable to connect or disconnect the patch to one of the at least two stubs.

35 Claims, 4 Drawing Sheets

A PHASE STATE = 0°, ROTATION ANGLE = 0°
B PHASE STATE = 45°, ROTATION ANGLE = −22.5°
C PHASE STATE = 90°, ROTATION ANGLE = −45°
D PHASE STATE = 135°, ROTATION ANGLE = −67.5°
E PHASE STATE = 180°, ROTATION ANGLE = −90°
F PHASE STATE = 225°, ROTATION ANGLE = −112.5°
G PHASE STATE = 270°, ROTATION ANGLE = −135°
H PHASE STATE = 315°, ROTATION ANGLE = −157.5°

MICROSTRIP PHASE SHIFTING REFLECT ARRAY ANTENNA

RELATED PATENT APPLICATION

This application is related to U.S. Ser. No. 09/181457, entitled Integrated Microelectromechanical Phase Shifting Reflect Array Antenna (Attorney Docket 004578.0716), filed on Oct. 28, 1998.

TECHNICAL FIELD OF THE INVENTION

This invention is related in general to the field of antennas, and more particularly, to a microstrip phase shifting reflect array antenna.

BACKGROUND OF THE INVENTION

Many radar, electronic warfare and communication systems require a circularly polarized antenna with high gain and low axial ratio. Conventional mechanically scanned reflector antennas can meet these specifications. However, they are bulky, difficult to install, and subject to performance degradation in winds. Planar phased arrays may also be employed in these applications. However, these antennas are costly because of the large number of expensive GaAs Monolithic microwave integrated circuit components, including an amplifier and phase shifter at each array element as well as a feed manifold and complex packaging. Furthermore, attempts to feed each microstrip element from a common input/output port becomes impractical due to the high losses incurred in the long microstrip transmission lines, especially in large arrays.

Conventional microstrip reflect array antennas use an array of microstrip antennas as collecting and radiating elements. Conventional reflect array antennas use either delay lines of fixed lengths connected to each microstrip radiator to produced a fixed beam or use an electronic phase shifter connected to each microstrip radiator to produce an electronically scanning beam. These conventional reflect array antennas are not desirable because the fixed beam reflect arrays suffer from gain ripple over the reflect array operating bandwidth, and the electronically scanned reflect array suffer from high cost and high loss phase shifters.

In U.S. Pat. No. 4,053,895 entitled "Electronically Scanned Microstrip Antenna Array" issued to Malagisi on Oct. 11, 1977, antennas having at least two pairs of diametrically opposed short circuit shunt switches placed at different angles around the periphery of a microstrip disk is described. Phase shifting of the circularly polarized reflect array elements is achieved by varying the angular position of the short-circuit plane created by diametrically opposed pairs of diode shunt switches. This antenna is of limited utility because of the complicated labor intensive manufacturing process required to connect the shunt switches and their bias network between the microstrip disk and ground.

It is also known that any desired phase variation across a circularly polarized array can be achieved by mechanically rotating the individual circularly polarized array elements. Miniature mechanical motors or rotators have been used to rotate each array element to the appropriate angular orientation. However, the use of such mechanical rotation devices and the controllers introduce mechanical reliability problems. Further, the manufacturing process of such antennas are labor intensive and costly.

SUMMARY OF THE INVENTION

It has been recognized that it is desirable to provide a high performance circularly polarized beam scanning array antenna that is low in cost and easy to manufacture.

In one aspect of the invention, an antenna array element has an electrically conductive patch, at least two electrically conductive stubs positioned along the periphery of the patch, and at least two switches each operable to connect or disconnect the patch to one of the at least two stubs.

In another aspect of the invention, an antenna includes an array of electrically conductive patches arranged in a predetermined generally equally spaced pattern on a first surface of a substantially flat substrate, at least two electrically conductive stubs positioned along the periphery of each of the patches, and at least two switches coupled between each patch and the at least two stubs. A controller is coupled to each of the at least two switches operable to connect or disconnect a selected one of the at least two stubs to each patch.

In another aspect of the present invention, a method of electronically phase shifting array elements in a reflect array antenna includes the steps of generating and directing energy toward N sets of patches disposed on a substantially flat surface and arranged in a predetermined pattern thereon, selectively connecting patches, for each of N sets of patches, to a different stub out of N stubs arranged along half of the periphery of each patch, thereby applying a phase shift to the energy, reradiating into space.

In yet another aspect of the present invention, a method of electronically phase shifting array elements in a reflect array antenna includes the steps of generating and directing energy toward N sets of patches disposed on a substantially flat surface and arranged in a predetermined pattern thereon, selectively connecting patches, for each of N sets of patches, to a different pair of diametrically opposed stubs out of N pairs of diametrically opposed stubs arranged along the periphery of each patch, thereby phase shifting the energy, and reradiating the energy into space.

BRIEF DESCRIPTION OF THE DRAWINGS

For a better understanding of the present invention, reference may be made to the accompanying drawings, in which.

DETAILED DESCRIPTION OF THE INVENTION

Figure 1:
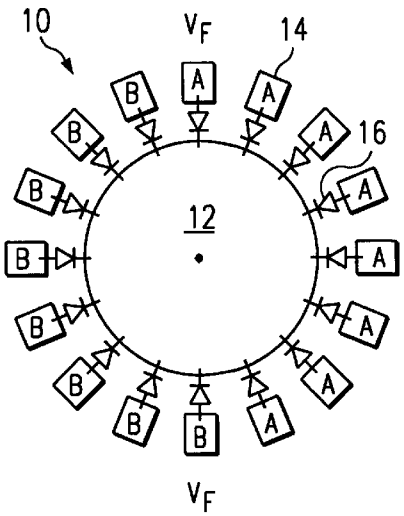
FIG. 1 is a schematic representation of the array element constructed according to an embodiment of the present invention.

Referring to FIG. 1, a detailed schematic representation of an array element 10 for a microstrip phase shifting reflect array antenna constructed according to the teachings of the present invention is shown. Array element 10 includes an electrically conductive microstrip patch 12, which is preferably circular in shape. Arranged radially around patch 12 are a plurality of stubs 14 also constructed of an electrically conductive material. Each stub 14 is coupled to the periphery or edge of microstrip patch 12 by a low loss switch 16, such as a diode (shown), transistor, micromechanical switch, electromechanical switch and the like. When forward biased, the diode switch connects the respective stub 14 to microstrip patch 12; when reverse biased, the diode switch disconnects the respective stub 14 from microstrip patch 12. At any one instant during the operation of the antenna, switch controllers 18 generate and send control signals to switches 16 so that only two diametrically opposed stubs are connected to each microstrip patch 12 with the rest disconnected therefrom. Therefore, depending on which two diametrically opposed stubs are connected to patch 12, a rotational effect and electronic phase shift is achieved. Although FIG. 1 is shown with only two stubs coupled to controller 18 for the sake of clarity and simplicity, it may be understood that all the radial stubs are coupled to controller 18, which controls the connectivity thereof to the microstrip patch.

Figure 2B:
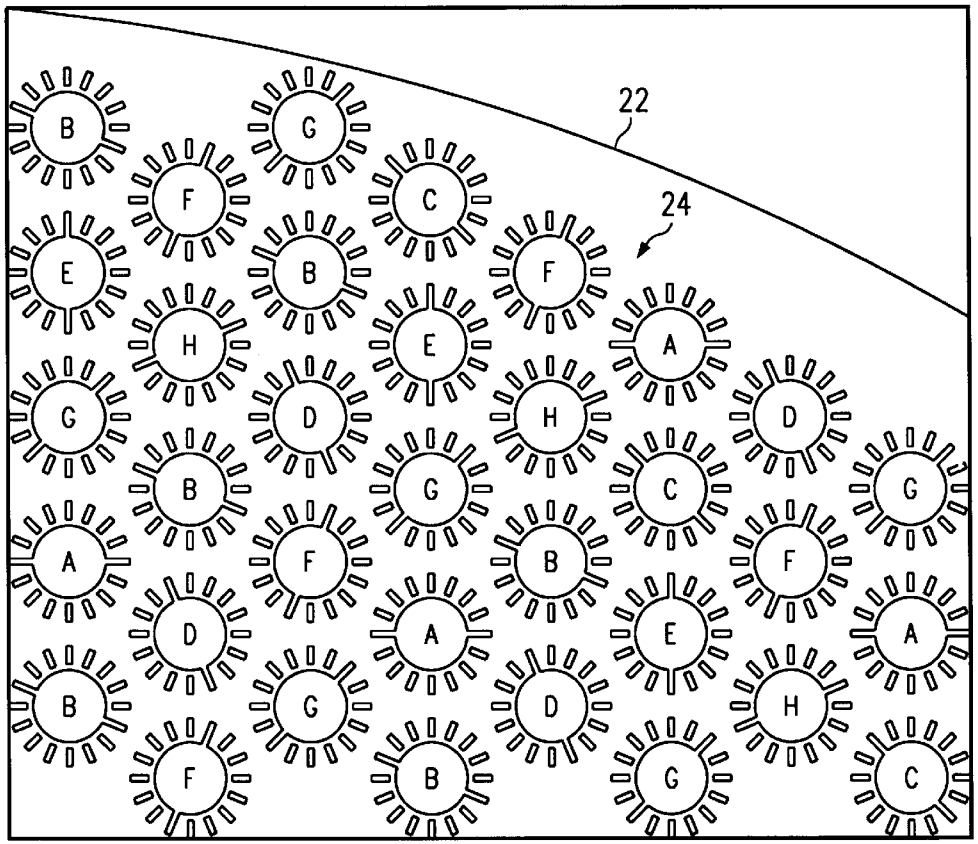
FIG. 2B is an enlarged view of an inset shown in FIG. 2A showing the array elements of the antenna and the phase state and rotation angles thereof constructed according to an embodiment of the present invention.
Figure 2A:
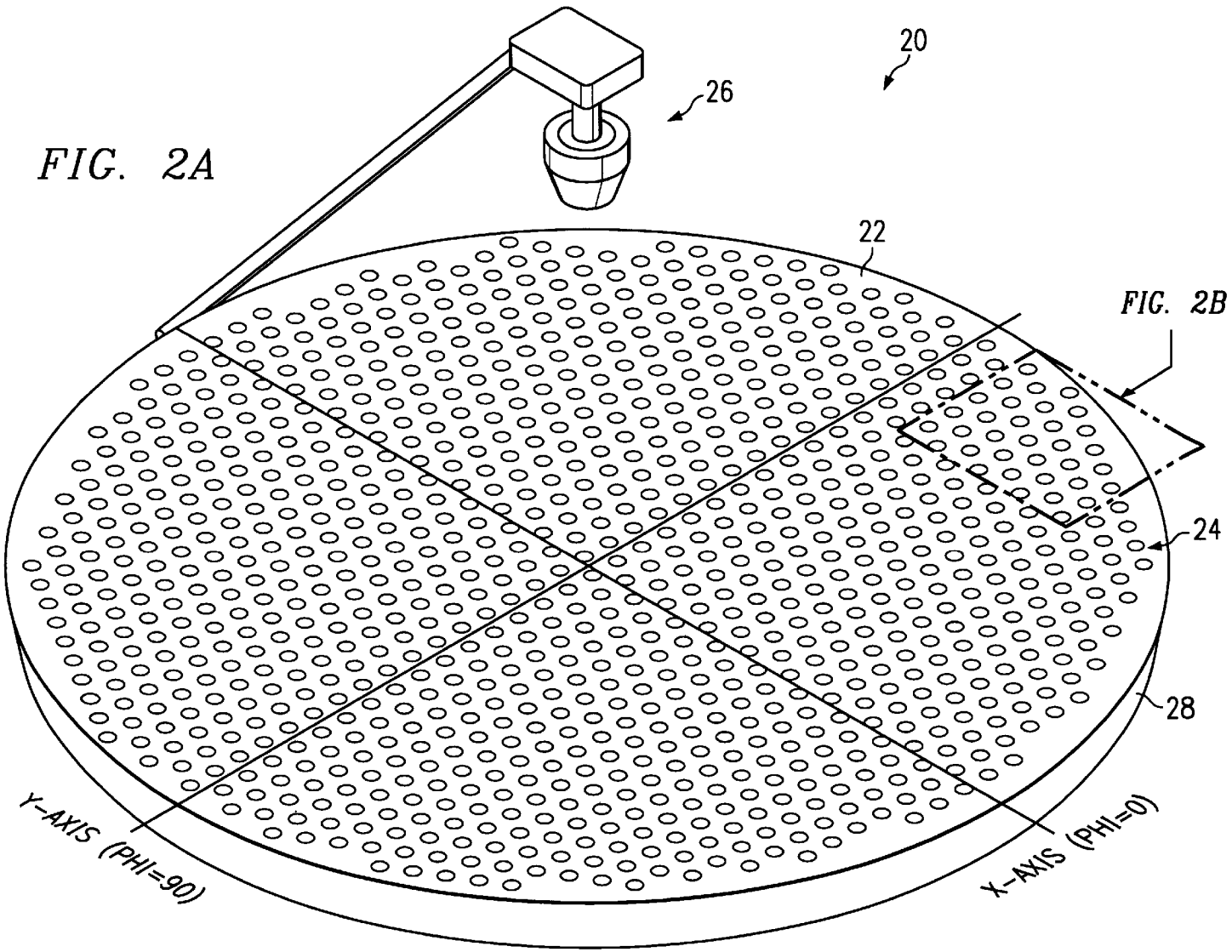
FIG. 2A is a perspective view of a microstrip phase shifting reflect array antenna shown with an offset feed horn constructed according to an embodiment of the present invention.

Referring to FIGS. 2A and 2B, a microstrip phase shifting reflect array antenna 20 constructed in accordance with the teachings of the present invention is shown. Antenna 20 may include a substantially flat dielectric substrate 22 upon which a plurality of array elements 24 are disposed in a regular and repeating pattern. As shown in FIGS. 2A and 2B, array elements 24 are arranged in rows and columns on disk 22, but may be arranged in other random or concentric patterns in accordance with array antenna theory. A feed horn 26 is located above disk 22, either offset (as shown) or centered, over the plurality of array elements 24. Array elements 24 may be etched on a ceramic filled PTFE substrate, which may be supported and strengthened by a thicker flat panel 28. Although antenna 20 is shown on a substantially flat substrate, the invention contemplates substrates that may be curved or conformed to some physical contour due to installation requirements or space limitations. The variation in the substrate plane geometry, the spherical wave front from the feed and to steer the beam may be corrected by modifying the phase shift state of array elements 24. Furthermore, the substrate may be fabricated in sections and then assembled on site to increase the portability of the antenna and facilitate its installation and deployment.

In FIG. 2B, a portion of the plurality of array elements 24 is shown to demonstrate the phase states and respective rotation angles for a LHCP (left hand circularly polarized) Ku-Band reflect array. As shown in FIG. 1, array element 10 includes 16 stubs and thus eight different rotation angles which correspond to eight phase states. This configuration is equivalent to a three-bit phase shifter. TABLES A and B below list the angular stub positions required for a three-bit and four-bit microstrip phase shifting reflect array antenna with diametrically located stubs.

TABLE A

| 4-Bit Phase Shift (degrees) | Rotation of Diametrically Located Stubs for RHCP (degrees) | |
|---|---|---|
| | Stub 1 | Stub 2 |
| 0 | 0 | 180 |
| 22.5 | 11.25 | 191.25 |
| 45 | 22.5 | 202.5 |
| 90 | 45 | 225 |
| 135 | 67.5 | 247.5 |
| 180 | 90 | 270 |
| 225 | 112.5 | 292.5 |
| 270 | 135 | 315 |
| 315 | 157.5 | 337.5 |

TABLE B

| 4-Bit Phase Shift (degrees) | Rotation of Diametrically Located Stubs for RHCP (degrees) | |
|---|---|---|
| | Stub 1 | Stub 2 |
| 0 | 0 | 180 |
| 22.5 | 11.25 | 191.25 |
| 45 | 22.5 | 202.5 |
| 67.5 | 33.75 | 213.75 |
| 90 | 45 | 225 |
| 112.5 | 56.25 | 236.25 |
| 135 | 67.5 | 247.5 |
| 157.5 | 78.75 | 258.75 |
| 180 | 90 | 270 |
| 202.5 | 101.25 | 281.25 |
| 225 | 112.5 | 292.5 |
| 247.5 | 123.75 | 303.75 |
| 270 | 135 | 315 |
| 292.5 | 146.25 | 326.25 |
| 315 | 157.5 | 337.5 |
| 337.5 | 168.75 | 348.75 |

A more efficient array element configuration requires only one stub connection at each rotational angle. Therefore, only one stub rather than two diametrically opposed stubs connected to patch 22 at any one instant has the same effect. This characteristic may be utilized advantageously to reduce the fabrication cost and complexity or to increase the robustness and reliability of the antenna. For each phase state, one stub and its connection may fail without adversely impacting the antenna operation. For example referring to FIG. 1, if all stubs in set B fail, the remaining stubs in set A will still enable array element 10 to function. TABLES C and D below list the angular stub positions for a three-bit and four-bit microstrip phase shifting reflect array antenna with single stubs, respectively.

TABLE C

| 3-Bit Phase Shift (degrees) | Single Stub (degrees) |
|---|---|
| 0 | 0 or 180 |
| 45 | 22.5 or 202.5 |
| 90 | 45 or 225 |
| 135 | 67.5 or 247.5 |
| 180 | 90 or 270 |
| 225 | 12.5 or 292.5 |
| 270 | 135 or 325 |
| 315 | 157.5 or 347.5 |

TABLE D

| 4-Bit Phase Shift (degrees) | Single Stub (degrees) |
|---|---|
| 0 | 0 or 180 |
| 22.5 | 11.25 or 191.25 |
| 45 | 22.5 or 202.5 |
| 67.5 | 33.75 or 213.75 |
| 90 | 45 or 225 |
| 112.5 | 56.25 or 236.25 |
| 135 | 67.5 or 247.5 |
| 157.5 | 78.75 or 258.75 |
| 180 | 90 or 270 |
| 202.5 | 101.25 or 281.25 |
| 225 | 112.5 or 292.5 |
| 247.5 | 123.75 or 303.75 |
| 270 | 135 or 315 |
| 292.5 | 146.25 or 326.25 |
| 315 | 157.5 or 337.5 |
| 337.5 | 168.75 or 348.75 |

Alternatively, phase shifting may also be accomplished by selectively connecting every other stub arranged around the patch thereto.

Figure 3:
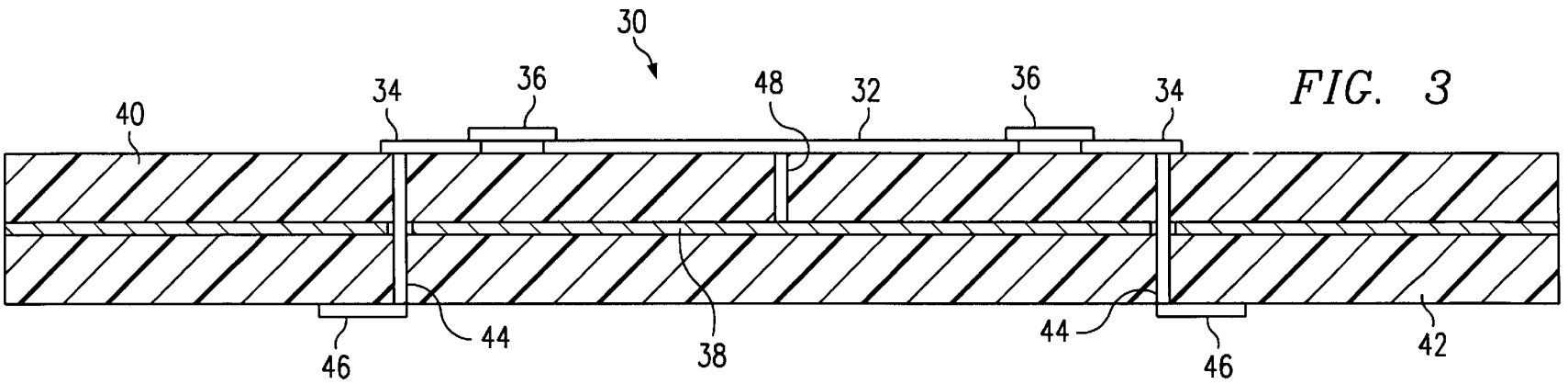
FIG. 3 is a cross-sectional view of an embodiment of an array element constructed according to the teachings of the present invention.

FIG. 3 is a cross-sectional view of one embodiment of an array element 30 according to the teachings of the present invention. Array element 30 includes a microstrip patch 32, a plurality of radial stubs 34 and respective switches 36 fabricated or mounted on a first side of a dielectric substrate with at least a top layer 40 and a bottom layer 42. An electrical reference or ground plane 38 may be sandwiched between dielectric layers 40 and 42 and coupled to the center of microstrip patch 32 by via 48. Stubs 34 may be coupled to switch control transmission lines 46 disposed on a second side of the dielectric substrate by DC vias 44. Switch control transmission lines 46 are coupled to one or more switch controllers 18, which may be mounted on the surface of bottom dielectric layer 42.

Microstrip phase shifting reflect array antenna 20 containing array element 30 may be constructed using conventional circuit board fabrication processes. For example, vias 44 and 48 may be formed in copper clad ceramic filled PTFE substrates, and array element patches 32 and stubs 34 may be formed by etching the copper cladding. Array element patches 32 may be of a shape other than circular. Switches 36 and switch controllers 18 may then be mounted on the dielectric substrate using standard chip on board or surface mount techniques.

Figure 4:
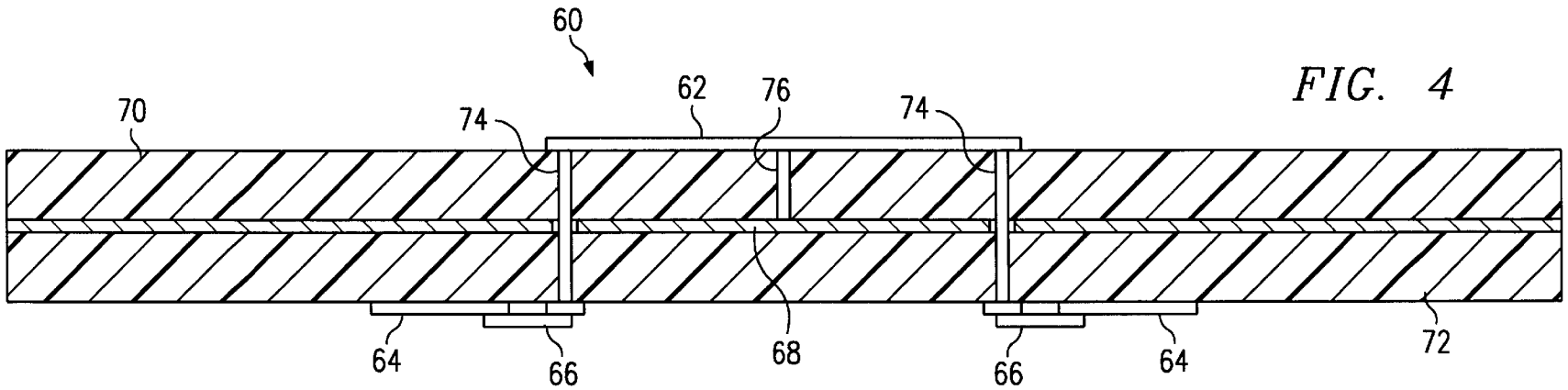
FIG. 4 is a cross-sectional view of another embodiment of an array element constructed according to the teachings of the present invention.

Referring to FIG. 4, a cross-sectional view of another embodiment of an array element 60 is shown. Array element 60 includes a microstrip patch 62 disposed on a top side of a dielectric substrate 70. A plurality of radial stubs 64 are disposed on a bottom side of a second dielectric substrate 72 which is bonded or coupled to dielectric substrate 70 with a ground reference plane 68 disposed therebetween. Switches 66 are coupled to stubs and switch control transmission lines 64 and also to RF vias 74 leading to the periphery of microstrip patch 62. In this embodiment, because microstrip patches 62 and stubs 64 are disposed on different sides of the multi-layer dielectric substrate, the array elements can be placed closer together to increase the compactness of the antenna. Further, this configuration also reduces reflections from and coupling with the stubs. The stubs may also be fabricated in stripline to reduce coupling with the DC layers.

Figure 5:
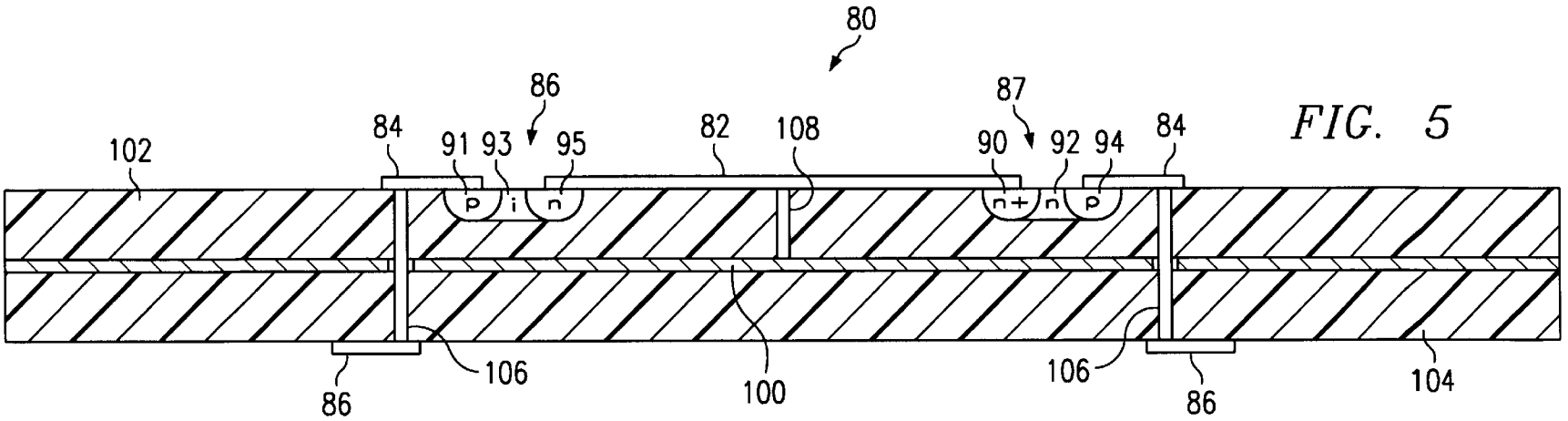
FIG. 5 is a cross-sectional view of another embodiment of an array element constructed according to the teachings of the present invention.

FIG. 5 is a cross-sectional view of yet another embodiment of an array element 80 constructed on a semiconductor and dielectric or semiconductor substrate 102 and 104 according to the teachings of the present invention. Array element 80 includes a microstrip patch 82 and its stubs 84 formed on the surface of semiconductor substrate 102. Semiconductor substrate 102 may be silicon, gallium arsenide, or like materials. Between the edge of microstrip patch 82 and stubs 84, a plurality of PIN junction switch 86 or PN junction switch 87 are formed on the surface of semiconductor substrate 102. The fabrication of PIN or PN junctions employs conventional or known semiconductor processes such as epitaxial growth, ion implantation, diffusion and the like and therefore is not described in detail herein. PIN junction switch 86 includes a p-type region 91, an intrinsic region 93, and an n-type region 95. PN junction switch 87 includes an n+ region 90, an n-type region 92, and a p-type region 94. Accordingly, semiconductor substrate 102 may be of a p-type material with intrinsic region 93 and n-type regions 90, 92 and 95 implanted, grown or otherwise formed therein; alternatively, semiconductor substrate 102 may be of an n-type material with intrinsic region 93 and p-type regions 91 and 94 implanted, grown or otherwise formed therein.

Microstrip patch 82 is coupled to a ground or reference plane 100 sandwiched between semiconductor substrate 102 and dielectric or semiconductor substrate 104. The switch controllers 18 and switch control transmission lines 86 may be mounted and formed on the surface of the dielectric or semiconductor substrate 104. Vias 106 couple switch control transmission lines 86 to radial stubs 84 for conveying DC control signals from the switch controllers to radial stubs 84. The center of microstrip patch 82 is coupled to ground plane 100 by via 108.

Figure 6:
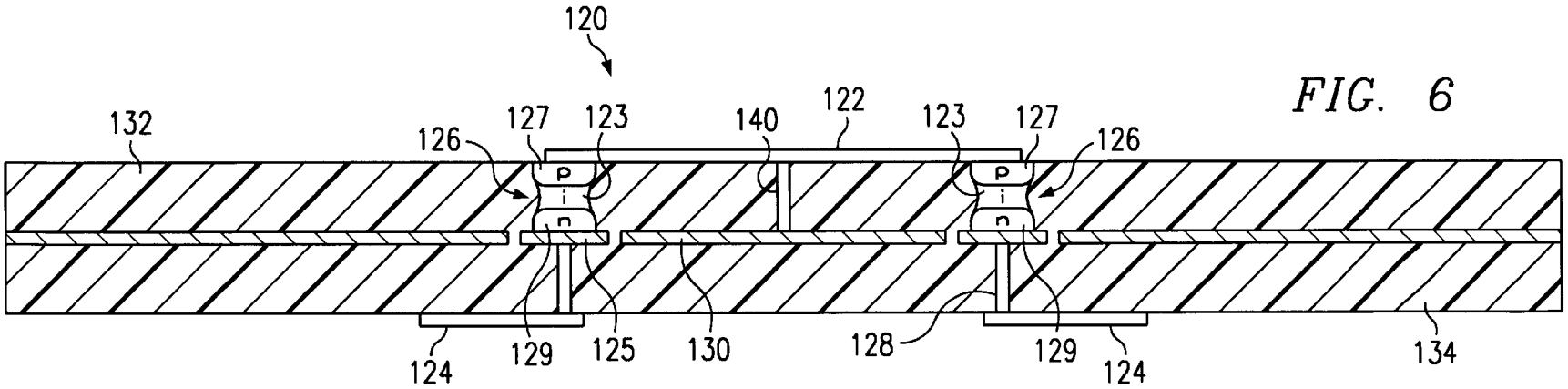
FIG. 6 is a cross-sectional view of yet another embodiment of an array element constructed according to the teachings of the present invention.

Referring to yet another embodiment of an array element 120 shown in FIG. 6. Array element 120 is also constructed on a semiconductor substrate 132 and a dielectric substrate 134 with a ground plane 130 sandwiched therebetween. A microstrip patch 122 is disposed on the surface of semiconductor substrate 132 and its center is coupled to ground plane 130 by via 140. PIN junction switches 126 are formed at the periphery of microstrip patch 122 between microstrip patch 122 and an intermediate plane 125. PIN junction switches 126 includes a p-type region 127 disposed immediately below the periphery of the microstrip patch 122, an n-type region 129 disposed above intermediate plane 125, and an intrinsic region 123 disposed therebetween. Radial stubs and switch control transmission lines 124 are formed on the surface of dielectric substrate 134, and switch controllers 18 may be mounted on the same surface. Radial stubs 124 are coupled to intermediate plane 125 and PIN junction switch 126 by DC vias 128. This configuration allows array elements 120 to be placed more closely together compared with the embodiment shown in FIG. 5.

Constructed in this manner, the switches, whether they be diodes, transistors, PIN junctions, PN junctions, or any low loss switch, are biased appropriately to either connect or disconnect the radial stubs from the periphery of the microstrip patches to effect beam scanning.

The reflect array antenna of the present invention is more reliable than conventional reflect arrays or phased arrays. Given that a conventional 4-Bit delay line phase shifter and a microstrip phase shifting reflect array antenna use the same type of switches, and $$N\,2^B \tag{1}$$

where N is the number of states and B is the number of bits. Then an array element with orthogonal stubs will have 2N diodes. The number of diodes in a delay line phase shifter is given by

MB (2)

where M is the number of diodes per bit and B is the number of bits. If p is the probability of failure for a single diode then the probability of success for the antenna is given by $$P_{MDPSA} = \frac{N-1}{N} + \frac{1}{N}(1-p)^2 \cong 1 - \frac{2p}{N} \tag{3}$$

and the probability of failure is $$P^F_{MDPSA} \approx \frac{2p}{N} \tag{4}$$

Similarly, the probability of success for the delay line phase shifter is given by $$P_{DL}(1p)^{MB} \tag{5}$$

and the delay line phase shifter probability of failure is $$P^F_{DL} = MBp \tag{6}$$

The increased failure rate of the delay line phase shifter over the microstrip phase shifting reflect array antenna is given by $$\frac{P^F_{DL}}{P^F_{MDPSA}} \cong \frac{MBp}{\left(\frac{2p}{N}\right)} = \frac{MBN}{2} = \frac{M}{2} N\log_2 N \tag{7}$$

Therefore, for a conventional 4-Bit delay line phase shifter with M=4 and a microstrip phase shifting reflect array antenna with orthogonal stubs and N=16, the antenna is at least 128 times more reliable. Furthermore, since the microstrip phase shifting reflect array elements do not have amplifiers at each element, they generate much less heat, therefore, do not suffer the damaging effects associated with high temperature thermal cycling. Finally, the phase shifting reflect array has no moving parts. For these reasons the microstrip phase shifting reflect array should exhibit higher electrical and mechanical reliability than phased array or mechanically steered antennas.

Although several embodiments of the present invention and its advantages have been described in detail, it should be understood that various mutations, changes, substitutions, transformations, modifications, variations, and alterations can be made therein without departing from the teachings of the present invention, the spirit and scope of the invention being set forth by the appended claims.

What is claimed:

1. An antenna element comprising:

an electrically conductive patch;

at least two electrically conductive stubs disposed generally orthogonally with respect to the periphery of the patch;

at least one switch operable to connect or disconnect the patch to a selected one of the at least two stubs;

a dielectric substrate having a first surface and a second surface;

the patch being disposed on the first surface;

the at least two switches being disposed on the first surface; and the at least two stubs being disposed on the first surface;

switch control lines disposed on the second surface of the dielectric substrate; and a least two DC vias through the dielectric substrate operable to couple the at least two stubs to the switch control lines.

2. The antenna element, as set forth in claim 1, further comprising an electrical reference plane coupled to each patch.

3. The antenna element, as set forth in claim 1, wherein the patch is a circular disk.

4. The antenna element, as set forth in claim 1, wherein each of the at least two switches comprises a diode coupled between the periphery of the patch and one end of a stub.

5. The antenna element, as set forth in claim 1, wherein the at least two stubs comprise at least two pairs of diametrically positioned electrically conductive stubs radially arranged around the periphery of the patch, each stub having a first end disposed adjacent to the periphery of the patch and a second end disposed remotely from the patch, and the at least two switches comprise at least two pairs of switches operable to connect or disconnect the periphery of the patch to the first ends of one selected pair of stubs to electronically rotate the patch.

6. The antenna element, as set forth in claim 1, wherein the at least two stubs and switches comprises:

2N stubs radially arranged and equally spaced along the periphery of the patch; and N switches each operable to connect and disconnect the patch to one of N stubs arranged equally spaced along the periphery of only half of the patch to electronically rotate the patch.

7. The antenna element, as set forth in claim 1, wherein the at least two stubs comprise eight pairs of diametrically opposed stubs arranged radially and equally spaced along the periphery of the patch, and the at least one switch comprises eight switches, each switch operable to coupled one selected stub of a pair of diametrically opposed stubs.

8. The antenna element, as set forth in claim 1, wherein the at least two stubs and switches comprise:

N pairs of diametrically opposed stubs arranged radially and equally spaced along the periphery of the patch; and N switches operable to connect or disconnect one selected stub of each pair of diametrically opposed stubs to electronically rotate the patch.

9. An antenna element comprising:

an electrically conductive patch;

at least two electrically conductive stubs disposed generally orthogonally with respect to the periphery of the patch;

at least one switch operable to connect or disconnect the patch to a selected one of the at least two stubs;

a dielectric substrate having a first surface and a second surface;

the patch being disposed on the first surface;

the at least two switches being disposed on the second surface;

the at least two stubs being disposed on the second surface; and at least two RF vias through the dielectric substrate operable to couple the patch to the at least two switches.

10. The antenna element, as set forth in claim 9, further comprising switch control lines disposed on the second surface of the dielectric substrate coupled to the at least two stubs.

11. An antenna element comprising:

an electrically conductive patch;

at least two electrically conductive stubs disposed generally orthogonally with respect to the periphery of the patch;

at least one switch operable to connect or disconnect the patch to a selected one of the at least two stubs;

a semiconductor substrate having a first surface and a second surface;

the patch being disposed on the first surface;

the at least two stubs being disposed on the first surface; and at least two p-n junction switches defined in the first surface of the semiconductor substrate between the periphery of the patch and the at least two stubs.

12. The antenna element, as set forth in claim 11, further comprising:

a dielectric substrate having a first surface and a second surface;

switch control lines disposed on the second surface of the semiconductor dielectric substrate; and a least two DC vias through the semiconductor substrate and dielectric substrates operable to couple the at least two stubs to the switch control lines.

13. The antenna element, as set forth in claim 14, further comprising switch control lines disposed at the interface between the second surface of the semiconductor substrate and the first surface of the dielectric substrate, and the switch control lines being coupled to the PIN junctions and the at least two stubs by the at least two RF vias.

14. An antenna element comprising:

an electrically conductive patch;

at least two electrically conductive stubs disposed generally orthogonally with respect to the periphery of the patch;

at least one switch operable to connect or disconnect the patch to a selected one of the at least two stubs;

a semiconductor substrate having a first surface and a second surface;

the patch being disposed on the first surface;

the at least two stubs being disposed on the first surface; and at least two PIN junctions defined in the first surface of the semiconductor substrate between the periphery of the patch and the at least two stubs.

15. The antenna element, as set forth in claim 14, further comprising:

a dielectric substrate having a first surface and a second surface;

switch control lines disposed on the second surface of the dielectric substrate; and a least two DC vias through the semiconductor and dielectric substrates operable to couple the at least two stubs to the switch control lines.

16. An antenna element comprising:

an electrically conductive patch;

at least two electrically conductive stubs disposed generally orthogonally with respect to the periphery of the patch;

at least one switch operable to connect or disconnect the patch to a selected one of the at least two stubs;

an electrical reference plane coupled to each patch;

a semiconductor substrate having a first surface and a second surface;

a dielectric substrate having a first surface and a second surface, the electrical reference plane being disposed between the second surface of the semiconductor substrate and the first surface of the dielectric substrate;

the patch being disposed on the first surface of the semiconductor substrate;

the at least two stubs being disposed on the second surface of the dielectric substrate;

at least two PIN junctions defined in the semiconductor substrate between the periphery of the patch and the at least two stubs; and at least two RF vias through the dielectric substrate operable to couple the at least two PIN junctions to the at least two stubs disposed on the second surface of the dielectric substrate.

17. An antenna comprising:

an array of electrically conductive patches arranged in a predetermined pattern on a first surface of a substrate having a first surface and a second surface, and wherein all patches, the switches and stubs are disposed on the first surface of the substrate;

at least two electrically conductive stubs positioned generally orthogonally with respect to the periphery of each of the patches;

at least two switches disposed between each patch and the at least two stubs; and a controller coupled to each of the at least two switches operable to connect or disconnect a selected one of the at least two stubs to each patch to electronically phase shift the patches;

switch control lines disposed on the second surface of the substrate; and a least two DC vias through the substrate operable to couple the stubs to the switch control lines.

18. The antenna, as set forth in claim 17, further comprising an electrical reference plane coupled to each patch.

19. The antenna, as set forth in claim 17, wherein the substrate is substantially flat and comprises at least one dielectric substrate disposed adjacent the electrical reference plane.

20. The antenna, as set forth in claim 17, wherein each patch is a circular disk.

21. The antenna, as set forth in claim 17, wherein each of the at least two switches comprises a diode coupled between the periphery of the patch and one end of a stub.

22. The antenna, as set forth in claim 17, wherein the at least two stubs comprise at least two pairs of diametrically positioned electrically conductive stubs positioned radially around the periphery of the patch, and the at least two switches comprise at least two pairs of switches operable to connect or disconnect the periphery of the patch to one selected pair of diametrically opposed stubs.

23. The antenna, as set forth in claim 17, wherein each patch is dissected into two halves and the at least two stubs comprise eight stubs arranged along the periphery of only one half of the patch.

24. The antenna, as set forth in claim 17, wherein the at least two stubs comprise eight pairs of diametrically opposed stubs arranged along the periphery of the patch.

25. The antenna, as set forth in claim 17, wherein the substrate comprises a dielectric substrate.

26. The antenna, as set forth in claim 17, wherein the substrate comprises a dielectric substrate having a first surface and a second surface, and wherein the patches are disposed on the first surface of the dielectric substrate, and the switches and stubs are disposed on the second surface of the dielectric substrate.

27. The antenna, as set forth in claim 26, further comprising RF vias through the dielectric substrate operable to couple the patches to the switches.

28. The antenna, as set forth in claim 27, further comprising switch control lines disposed on the second surface of the dielectric substrate coupled to the stubs.

29. The antenna, as set forth in claim 17, wherein the substrate comprises a semiconductor substrate having a first surface and a second surface, the patches and the stubs being disposed on the first surface of the semiconductor substrate, and at least two p-n junction switches defined in the first surface of the semiconductor substrate between the periphery of the patch and the stubs.

30. The antenna, as set forth in claim 29, wherein the substrate further comprises a dielectric substrate disposed adjacent to the semiconductor substrate, the dielectric substrate having a first surface adjacent to the second surface of the semiconductor substrate and a second surface, the antenna further comprising:

switch control lines disposed on the second surface of the dielectric substrate; and a least two DC vias through the semiconductor and dielectric substrates operable to couple the stubs to the switch control lines.

31. The antenna, as set forth in claim 17, wherein the substrate further comprises a dielectric substrate disposed adjacent to the semiconductor substrate, the dielectric substrate having a first surface adjacent to the second surface of the semiconductor substrate and a second surface, the patches, the stubs being disposed on the first surface, and the PIN junctions being defined in the first surface of the semiconductor substrate between the periphery of the patches and the stubs.

32. The antenna, as set forth in claim 31, further comprising:

switch control lines disposed on the second surface of the dielectric substrate; and a least two DC vias through the semiconductor and dielectric substrates operable to couple the stubs to the switch control lines.

33. The antenna, as set forth in claim 17, wherein the substrate further comprises a dielectric substrate disposed adjacent to the semiconductor substrate, the dielectric substrate having a first surface adjacent to the second surface of the semiconductor substrate and a second surface, the electrical reference plane being disposed between the second surface of the semiconductor substrate and the first surface of the dielectric substrate, the patches being disposed on the first surface of the semiconductor substrate, the stubs being disposed on the second surface of the dielectric substrate, the PIN junctions being defined in the semiconductor substrate between the periphery of the patch and the stubs, and RF vias through the dielectric substrate operable to couple the PIN junctions to the stubs disposed on the second surface of the dielectric substrate.

34. The antenna, as set forth in claim 33, further comprising switch control lines disposed at the interface between the second surface of the semiconductor substrate and the first surface of the dielectric substrate, and the switch control lines being coupled to the PIN junctions and the at least two stubs by the RF vias.

35. The antenna, as set forth in claim 17, wherein the array of patches are divided into N sets of patches, the patches of each set being arranged in a predetermined pattern on the substantially flat substrate, each patch having N pairs of diametrically opposed stubs arranged substantially equally spaced along the periphery thereof, and the patches in each N set of patches each having a different pair of the N pairs of diametrically opposed stubs selectively coupled to the patch by the switches.

* * * * *